US009511412B2

(12) United States Patent
Jolly

(10) Patent No.: US 9,511,412 B2
(45) Date of Patent: Dec. 6, 2016

(54) METHOD AND MACHINE FOR PRODUCING A MUSELET FOR BOTTLES OF EFFERVESCENT DRINKS

(71) Applicant: COMPTOIR COMMERCIAL CHAMPENOIS, Reims (FR)

(72) Inventor: Pierre Eric Jolly, Landreville (FR)

(73) Assignee: COMPTOIR COMMERCIAL CHAMPENOIS, Reims (FR)

( * ) Notice: Subject to any disclaimer, the term of this patent is extended or adjusted under 35 U.S.C. 154(b) by 114 days.

(21) Appl. No.: 14/396,550

(22) PCT Filed: Apr. 5, 2013

(86) PCT No.: PCT/FR2013/050749

§ 371 (c)(1),
(2) Date: Oct. 23, 2014

(87) PCT Pub. No.: WO2013/167819

PCT Pub. Date: Nov. 14, 2013

(65) Prior Publication Data

US 2015/0090362 A1 Apr. 2, 2015

(30) Foreign Application Priority Data

May 10, 2012 (FR) ..... 12 54289

(51) Int. Cl.
*B21F 45/04* (2006.01)
*B21F 7/00* (2006.01)
(Continued)

(52) U.S. Cl.
CPC ..... *B21F 45/04* (2013.01); *B21F 7/00* (2013.01); *B21F 15/04* (2013.01); *B65D 55/063* (2013.01)

(58) Field of Classification Search
CPC ..... B21F 7/00; B21F 15/04; B21F 45/04; B65D 41/56; B65D 55/063; B65D 55/06
See application file for complete search history.

(56) References Cited

U.S. PATENT DOCUMENTS 445,803 A * 2/1891 Curtis ..... B65D 55/063 140/94
625,591 A * 5/1899 Neff ..... B21F 45/04 140/85

(Continued)

FOREIGN PATENT DOCUMENTS

FR 892325 A 4/1944
FR 942540 A * 2/1949 ..... B21F 45/04

(Continued)

OTHER PUBLICATIONS

ISA/EP International Search Report issued Jul. 15, 2013 re PCT Application No. PCT/FR2013/050749, filed Apr. 5, 2013.

*Primary Examiner* — Edward Tolan
(74) *Attorney, Agent, or Firm* — Patrick J. Daugherty; Driggs, Hogg, Daugherty & Del Zoppo Co., LPA

(57) ABSTRACT

The invention relates to a method for producing a Y-shaped muselet for bottles of effervescent drinks, said muselet comprising a cage co-operating with a rim, the cage being formed by a first (1) and a second (2) wire and the muselet by a third wire. According to said method, the formation of the cage includes: twisting one end of the first wire (1) over an area located approximately in the center of the second wire (2), the wires forming part of the same first plane and being oriented in such a way as to form an essentially right angle between the non-twisted end of the first wire and one of the free ends of the second wire, and to form an angle of about 135° between the free ends of the second wire; forming a first loop (5) on each free end of the first and second wires, in said first plane; forming a second loop (6)

(Continued)

in a plane that is essentially perpendicular to the first plane, by folding; and folding the three wires at a certain distance from the twisting, in a plane essentially perpendicular to said first plane. Furthermore, a closed rim (3) is inserted such that it passes through the three loops by translation according to a direction essentially perpendicular to the first plane of the cage, and the three loops are closed by pressing in a direction parallel to said first plane. The invention also relates to a machine for implementing said method.

10 Claims, 5 Drawing Sheets

(51) Int. Cl.
*B65D 55/06* (2006.01)
*B21F 15/04* (2006.01)

(56) References Cited

U.S. PATENT DOCUMENTS 3,339,775 A 9/1967 Valentin
3,379,328 A * 4/1968 Plion ..... B21F 45/04
215/291

FOREIGN PATENT DOCUMENTS

FR 2918042 A1 1/2009
WO 2010/143220 A1 * 12/2010 ..... B21F 45/04

* cited by examiner

METHOD AND MACHINE FOR PRODUCING A MUSELET FOR BOTTLES OF EFFERVESCENT DRINKS

TECHNICAL FIELD OF THE INVENTION

The invention relates to the field of the closure and stoppering of bottles containing effervescent drinks, such as champagne bottles. These bottles therefore contain drinks exerting a certain gas pressure in particular on the member stoppering the bottle, which has to be kept hermetically closed for months and usually for years.

PRIOR ART

Known bottles each have a neck provided with a collar and the stoppering member conventionally comprises a stopper, in particular made of cork, pressed into the neck in part and held by a muselet. The muselet is generally metal and comprises essentially two parts: a cage around the stopper, and a rim which connects the free ends of the lugs making up the cage and which is restrained under the collar of the neck of the bottle. When the stopper is made of cork or an equivalent material, a metal cap may be interposed between the flat protruding part of the stopper and the associated part of the cage, so that the metal muselet is not pressed into the stopper. In fact, according to the type of drink contained in the bottle, the metal cap is either present or not present.

In the document FR 2 589 760 a method for manufacturing muselets is described, comprising the formation of a ring from which lugs extend, four in number, which are formed by twisting two wires over part of their length; the ends of the lugs form loops wound around the rim of the muselet, which is roughly oval in shape and has a ring intended to be twisted in order to lock the rim to the neck of the bottle. The feature of this muselet relates to the fact that at least one of the lugs is twisted in the opposite direction to the direction of twisting of the locking ring.

Many machines and methods have existed for years which are intended to form these stoppering members and to implant them in the necks of bottles of effervescent drinks.

By way of illustration, the document WO 89/11360 describes a machine intended to assemble the cage and rim of a muselet, at the loops disposed at the ends of the four lugs of the cage of the muselet.

The document DE 696 00 632 is also known, which discloses a machine for forming muselets and assembling them with the cap covering the cork stopper.

The prior art also includes the application WO 2010/143220 A1, which describes a machine for manufacturing cages, or more precisely for twisting two wires intended to form the four lugs of the cage of the muselet. Another wire is used to form the rim, which is then connected to the cage.

In order to improve this type of closure and stoppering for bottles of effervescent drinks, the applicant obtained the patent FR 2 918 042, which protects a muselet of which the cage comprises three lugs (or legs) disposed in a Y-shape and which join at the top of the cage. This muselet saves on wire because of the reduced number of lugs, all the more so since the three lugs are not necessarily all twisted and/or formed from two wires.

DISCLOSURE OF THE INVENTION

The invention aims to remedy the drawbacks of the prior art and in particular to manufacture, in a simple and ergonomic fashion, muselets of the type comprising three lugs.

To do this, a method for manufacturing a Y-shaped muselet for bottles of effervescent drinks is proposed, said muselet comprising a cage cooperating with a rim, the cage being formed by a first and second wire and the muselet by a third wire.

According to a first aspect of the invention, the formation of the cage comprises:

the twisting of one end of the first wire over a region situated approximately in the middle of the second wire, the wires forming part of the same first plane and being oriented therein so as to form an approximate right angle between the non-twisted end of the first wire and one of the free ends of the second wire, and to form an angle of approximately 135° between the free ends of the second wire;

the formation of a first loop at each free end of the first and second wires, in said first plane;

the formation of a second loop in a plane substantially perpendicular to the first plane, by folding;

the folding of the three wires at a certain distance from said twisting, in a plane substantially perpendicular to said first plane.

Moreover, a rim of specific shape is inserted and passed through the three second loops by translation in a direction substantially perpendicular to said first plane of the cage, and the three second loops are then closed by pressing their free ends in a direction parallel to said first plane.

Preferably the rim should rest free in the loops after their closure, as will be explained below.

In addition and more precisely, the manufacture of the muselet rim consists in: cutting a length of wire, greater than the circumference of the collar of the neck of the bottle; —curving the wire in a portion of a circle, substantially in the middle of said wire; —folding each free end of the wire by forming a right angle at a certain distance from the free end so as to obtain an overlap of said ends over a certain distance; —twisting the wires at the overlap region in order to form a closed periphery; —deforming said periphery in order to create two inflection points in its curvature, each of the inflection points delimiting a portion of a circle. The portion of a circle with the smallest diameter constitutes the surplus of wire intended for the creation of an unstoppering ring.

In order not to have any elements that project externally from the muselet, the end or ends of the wire projecting from the twisting of said rim are flattened by pressing.

Interestingly, for the balancing of forces, the rim is oriented relative to the cage so that the two loops of the cage angularly spaced apart by 90° are placed close to each of said inflection points. Thus the two lugs of the cage at 90° from each other are situated at the base of the surplus wire of the rim that forms the unstoppering ring.

The rim must remain free with respect to the lugs of the cage, in particular with respect to the two lugs placed at 90°. Thus the cages provided with their rims can be stacked with the lugs at 90° disposed alternately and contiguously. This feature makes it possible to obtain straight stacks (piles) that are properly wedged.

Advantageously, a heel is formed in each of said lugs, above said rim, by pressing said wire of the lug along said first plane, towards the inside of the cage. This feature enables the second loop of the lugs (or legs) to be housed, embedded under the collar of the neck of the bottle, and thereby enables the rim to be perfectly housed therein.

In addition, said second loops of the legs are oriented so that their opening region is turned towards the top of the neck of the bottle.

Preferably, said second loops are oriented so that their free branch is disposed towards the outside of the cage. Because of the arrangement of the three lugs, this feature is entirely suitable and ensures good holding of the cork by the muselet. This feature thus effects a kind of jamming of the opening by the collar of the bottle.

The invention also relates to a machine intended for manufacturing Y-shaped muselets for bottles of effervescent drinks, which comprises: means for manufacturing a cage provided with three legs; —means for connecting a rim by simultaneous passage through the three loops of said cage.

Interestingly, the Machine intended for manufacturing Y-shaped muselets for bottles of effervescent drinks comprises:

means for manufacturing a cage comprising the steps of:

the twisting of one end of a first wire over a region situated approximately in the middle of a second wire, the wires forming part of the same first plane and being oriented therein so as to form an approximate right angle A between the non-twisted end of the first wire and one of the free ends of the second wire, and to form an angle of approximately 135° between the free ends of the second wire;

the formation of a first loop at each free end of the first and second wires, in said first plane;

the formation of a second loop in a plane substantially perpendicular to the first plane, by folding;

the folding of the three wires at a certain distance from said twisting, in a plane substantially perpendicular to said first plane;

means for connecting a rim by simultaneous passage through the three second loops of said cage.

More precisely, the means intended to form the loops of the wires comprise pneumatic cylinders that actuate two parallel spindles that are able to rotate with respect to each other. As will be explained below, the pneumatic cylinders may actuate motors with a horizontal or vertical axis depending on the orientation of the loops to be formed.

Concerning the formation of the cage per se, the machine comprises in particular means intended to fold the three wires of the cage, which comprise a template in the form of a cap serving as a support substantially in said first plane, and three peripheral shoes at each leg, intended to fold said legs by pressing on the template.

Advantageously, the means intended to form the rim of the muselet comprise several stations disposed in a carousel. This reduces the size of the machine. A similar arrangement can be provided for the stations necessary for manufacturing the cage.

BRIEF DESCRIPTION OF THE FIGURES

Other features, details and advantages of the invention will emerge from reading the following description with reference to the accompanying drawings, in which.

For more clarity, identical or similar elements are provided with identical reference signs in all the figures.

DETAILED DESCRIPTION OF AN EMBODIMENT

Figure 1:
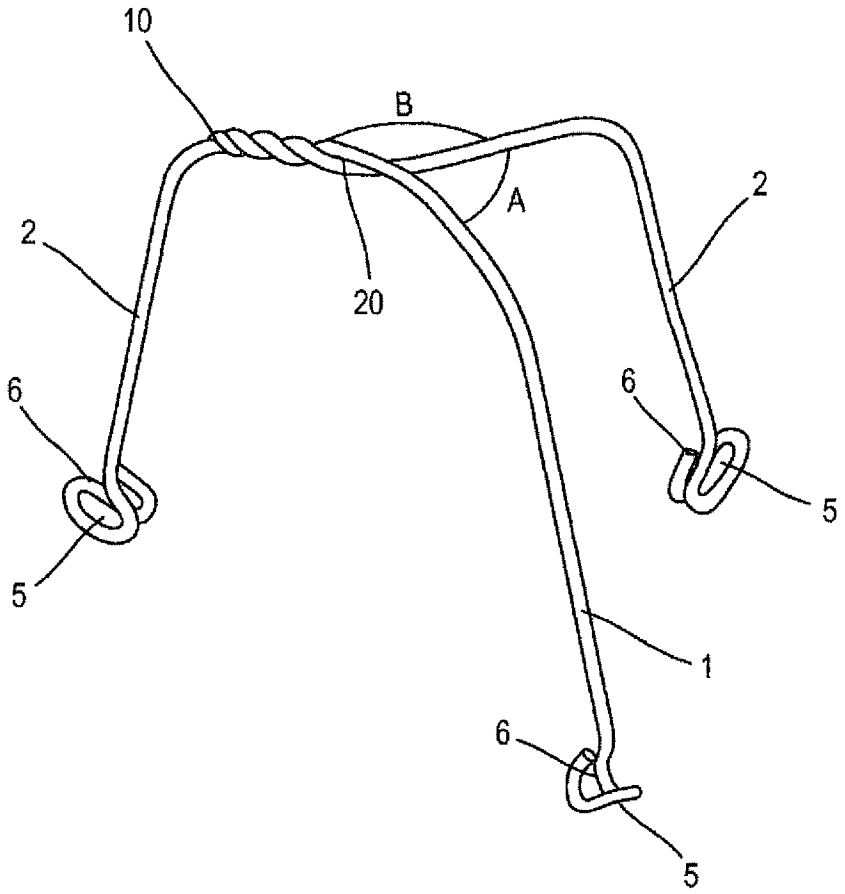
FIG. 1 is a perspective view of a muselet cage obtained by a method according to the invention.
Figure 2:
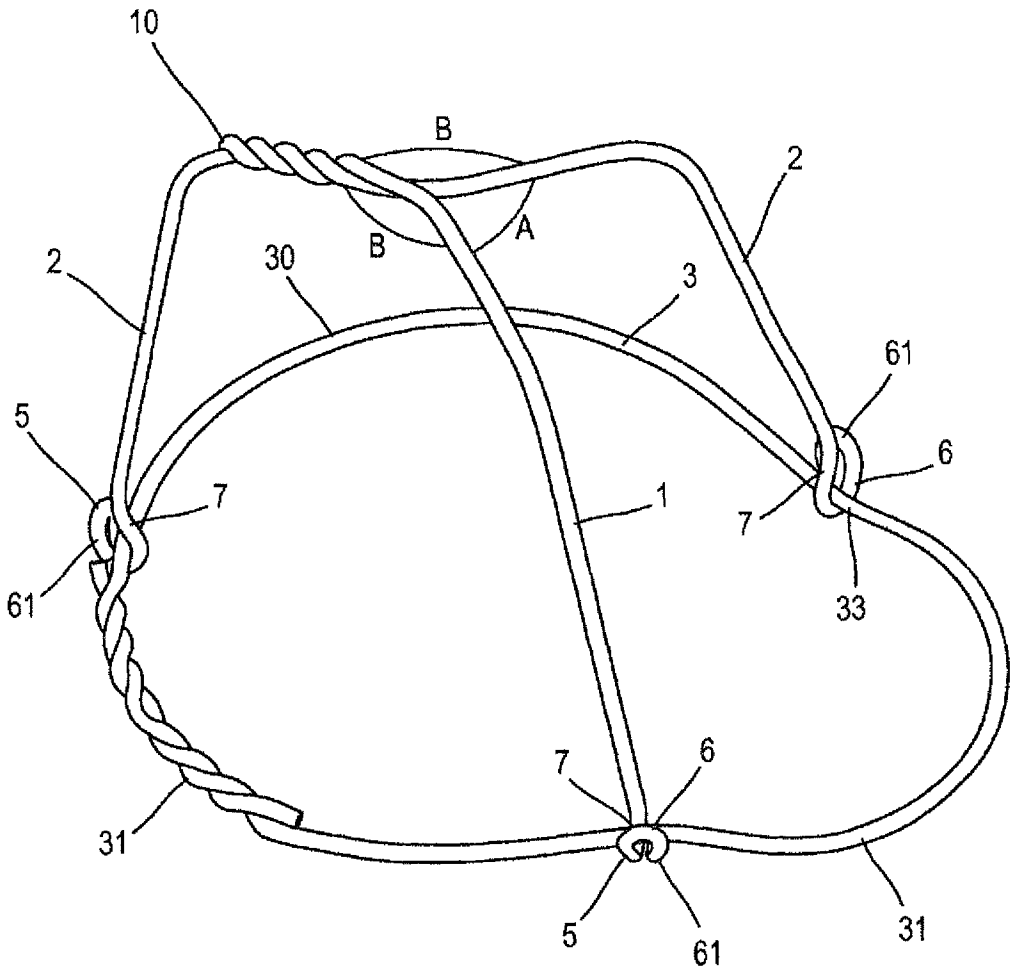
FIG. 2 is a perspective view of a muselet obtained by a method according to the invention.

FIG. 1 therefore illustrates a muselet cage obtained by a method according to the invention. It can be seen clearly that this cage has three legs (or lugs) respectively formed by a first 1 and second 2 wire. As shown by FIG. 2, a rim 3 formed by a third wire 3 is connected to the cage in order to form the muselet.

Figure 4:
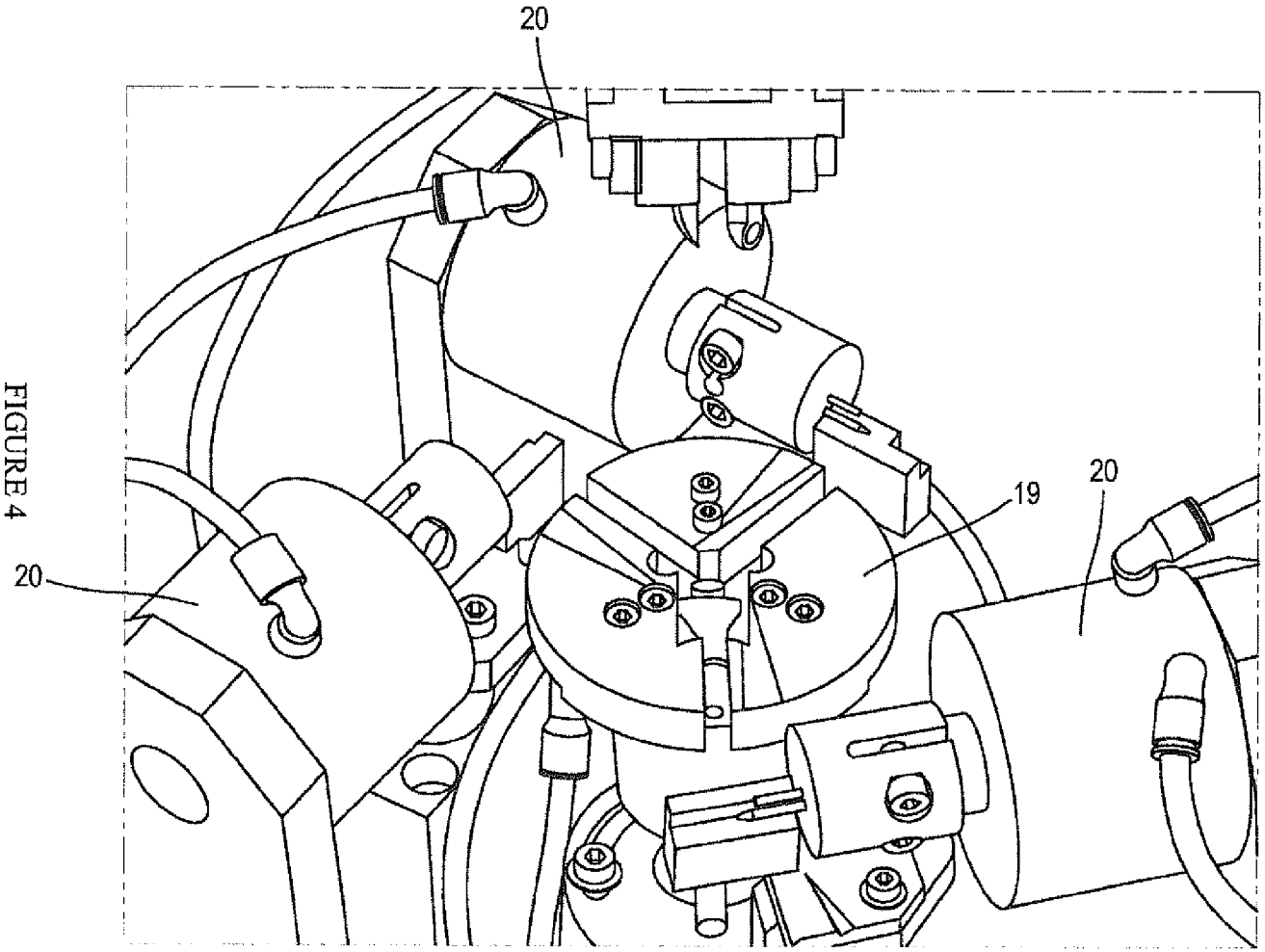
FIG. 4 is a perspective view of the means for forming a second loop at the free ends of the wires.

Interestingly, the formation of the cage comprises the twisting of one end 10 of the first wire 1 over a region 20 substantially situated in the middle of the second wire 2. At this stage the wires 1, 2 form part of the same first plane, substantially merged with the plane of the top of the cage once formed. In addition the wires are here oriented so as to form, in the first plane: an approximate right angle A (90°) between the non-twisted end of the first wire 1 and one of the ends of the second wire 2; an angle B of approximately 135° between the free ends of the second wire 2. The angles A and B are clearly depicted in FIG. 1. The template 19 used to place the wires in this configuration is visible in FIG. 4. In plan view the wires thus oriented form a Y-shape that gives the generic name of the muselet. Provided that the length of wire necessary has been properly determined, there is no waste of material.

Figure 3:
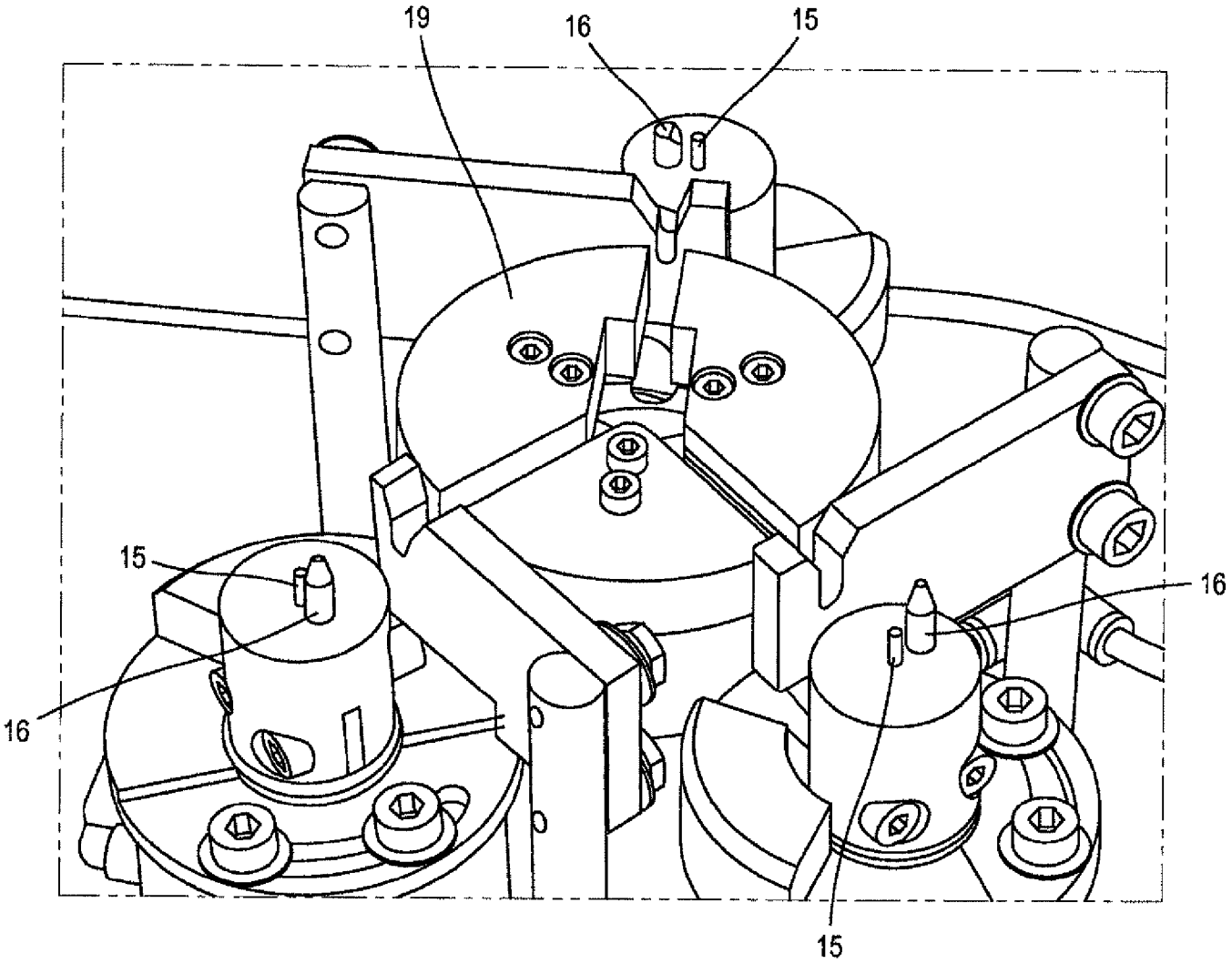
FIG. 3 shows the means for forming a first loop at the free ends of the wires.

The following step consists in forming a first loop 5 at each free end of the first 1 and second 2 wires, in said first plane. These loops 5 are in some sense security loops. They may be formed by an apparatus as depicted in FIG. 3 which comprises in particular three pneumatically actuated motors, each carrying a spindle 15 and an off-centre point 16 between which the three ends of the wires disposed in a Y-shape are placed and held over the major part of their length in a template such as 19. A rotation of the motors makes it possible to form the three first loops 5 simultaneously in said first plane.

Next a second loop 6 is formed by folding the wire at the heel of the first loop 5, at each of said first loops 5. The folding takes place in a plane substantially perpendicular to the first plane and forms second loops 6 which are open towards the top, as will be mentioned below.

Figure 5:
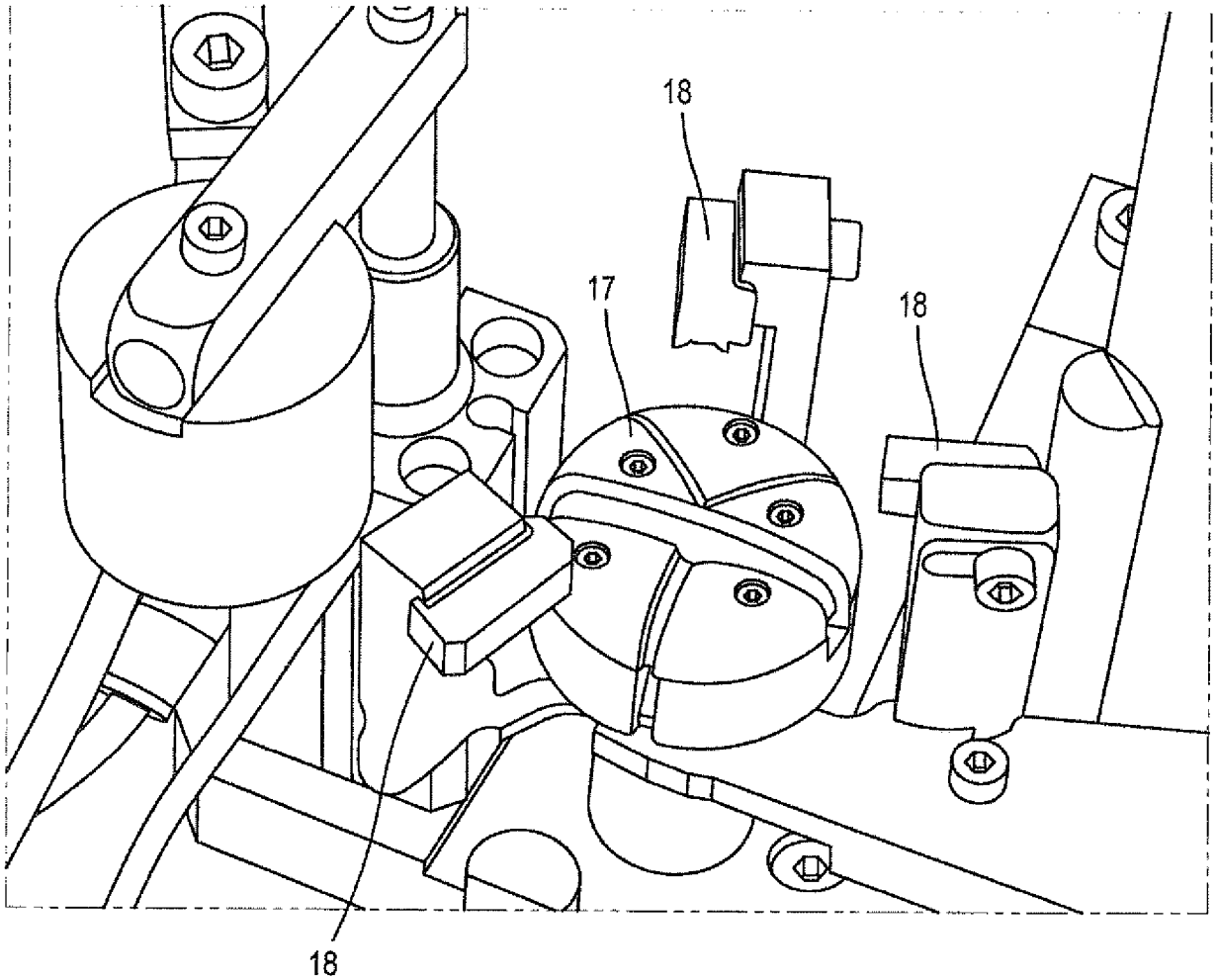
FIG. 5 shows the means for folding the three wires to form the volume of the cage.

Another step of the method consists in folding of the wires at a certain distance from said twisting region 20 in order to make them adopt the top external form of the muselet. For this purpose and as illustrated by FIG. 5, the wires are placed and pressed against a template 17 in the shape of a stopper cap, said template moreover being grooved in order to house and position the three branches of the Y-shape contained over their entire length in the first plane. The muselet is positioned so that the second loops are turned in the opposite direction to the face of the template. Three shoes 18 disposed at the three wires fold them substantially at a right angle to the first plane, each in a plane substantially perpendicular to said first plane. In this way a muselet cage as depicted in FIG. 1 is formed.

To form the muselet, a rim 3 contained in a single plane and inserted simultaneously in the three second loops 6 is connected. FIG. 2 illustrates this assembly. Because of its specific form, the rim 3 is simply moved by a translation perpendicular to the first plane, so that it is inserted in the three loops 6 that are open towards the top of the cage. "Towards the top" means here "towards the part where the wires of the cage are joined by twisting".

Naturally, once this connection has been made, the three loops 6 are closed, for example by pressing, on themselves, enclosing the rim 3 while leaving it free, that is to say not completely fixed relative to the loops 6.

In order to improve the holding of the muselet on the neck of the bottle, a heel 7 can be formed just above the region where the second loop 6 is closed. This heel consists of a folding of the wire by forming an approximate right angle; it is sought here to conform the wire to the profile of the bottle and more precisely to the collar of the neck so that the wire perfectly matches this shape and bears fully on the bottom surface of the collar.

A preferred way of producing the rim 3 will now be specified. A length of wire is cut, naturally greater than the circumference of the collar of the neck of the bottle on which the muselet is to be fitted. The wire is curved along a portion of a circle 30 situated substantially in the middle of the length of the wire. Each end of the wire 3 is folded by forming a right angle at a certain distance from each end, so as to obtain an overlap of the ends over a certain distance. The ends are twisted at the overlap region 31; this results in forming a closed contour of the wire 3. Any known equipment allowing twisting can be used, such as for example a rack and pinion system; the two wires pass between the pinions in order to be mutually twisted. Then, for example by means of a spindle, and while holding the wire between two stops, pulling is carried out in a specific direction in order to deform the rim 3 and to form in particular two inflection points 32, 33 at the two stops disposed outside the closed contour of the rim 3. Finally, the two inflection points separate a first region, the circumference of which corresponds substantially to the first portion of a circle 30 and a second region that corresponds to the unstoppering ring 34.

The twisting of the rim 3 may have a wire end that projects towards the outside of the cage; it is then chosen to exert a pressure on this projecting point since it is liable to interfere with the conveying of the muselets in the manufacturing line, in particular in the transport chutes. This is because a projection of a wire end towards the outside of the volume defined by the cage may cause stoppage of the manufacturing process, either by direct detection by sensors, or by catching in regions where the muselets are conveyed, in particular for manufacturing at high rates. Because of this, the external circumference of the rim must be smooth, without any roughness.

In addition, the cage 1, 2 and the rim 3 are advantageously oriented as follows: the two loops forming an angle of 90° therebetween are placed at the inflection points 32, 33 of the rim 3. Thus the third loop is placed close to the twisting region 31. This arrangement ensures better resistance to the forces exerted by the stopper on the muselet.

The second loops 6 of the cage are disposed with their opening oriented towards the top of the neck of the bottle; their free branch is disposed towards the outside of the cage.

The present invention also relates to the Machine intended for manufacturing the muselets described above. Means known per se are provided for certain steps, in particular for manufacturing the rim; specific means are used here for producing said Y-shaped muselet.

Advantageously, pneumatic cylinders are chosen, connected to the motors that allow the main steps constituting the manufacture both of the cage and of the rim of the muselet.

In order to optimise the space necessary for this manufacture, the stations necessary for manufacturing the rim are disposed in a carousel.

Various technologies and tools can be chosen by a person skilled in the art to perform the main steps stated above. In particular automatic controllers are envisaged for optimising in particular the manufacturing time on an industrial scale.

The invention claimed is:

1. Method for manufacturing a Y-shaped muselet for bottles of effervescent drinks, the method comprising:

twisting one end of a first wire over a region situated approximately in a middle of a second wire, the first and second wires forming part of a same first plane and being oriented therein so as to form an approximate first right angle between a non-twisted end of the first wire and one of free ends of the second wire, and to form a second angle of approximately 135° between the free ends of the second wire;

forming three first loops, one each at each free end of the first and second wires, in said first plane;

forming three second loops, one each at each free end of the first and second wires, in a plane substantially perpendicular to the first plane, by folding;

forming a cage from the first and second wires for cooperating with a rim formed by a third wire; and folding the three wires at a certain distance from said twisting step, in a plane substantially perpendicular to said first plane;

wherein the rim with a closed periphery inserted and passed through the three second loops by translation in a direction substantially perpendicular to said first plane of the cage, and wherein the three second loops are closed by pressing their free ends in a direction parallel to said first plane.

2. Manufacturing method according to claim 1, further comprising:

forming the rim of the muselet with the third wire by:

cutting a length of wire, greater than a circumference of a collar of a neck of a bottle;

curving the length of wire in a portion of a circle, substantially in a middle of said length of wire;

folding each free end of the length of wire by forming a right angle at a certain distance from the free end so as to obtain an overlap region of said ends over a certain distance;

twisting the wires at the overlap region in order to form a closed periphery;

deforming said closed periphery in order to create two inflection points in its curvature, each of the inflection points delimiting a surplus of wire intended for the creation of an unstoppering ring.

3. Method according to claim 2, further comprising:

flattening wire end projecting beyond the twisting of the wires at the overlap region of said rim by pressing.

4. Method according to claim 1, wherein the rim is oriented relative to the cage so that the first and second loops of the cage oriented at 90° from each other are placed close to each of said inflection points.

5. Method according to claim 1, further comprising:

forming a heel in each of lugs in the first and second wires, above said rim, by pressing wire of the lugs along said first plane, towards an inside of the cage.

6. Method according to claim 1, further comprising:

orienting said second loops so that their opening region is turned towards a top of the neck of the bottle.

7. Method according to claim 1, further comprising:

orienting said second loops so that their free branch is disposed towards an outside of the cage.

8. Machine intended for manufacturing Y-shaped muselets for bottles of effervescent drinks, comprising:

means for twisting of one end of a first wire over an overlap region situated approximately in a middle of a second wire, the wires forming part of a same first plane and being oriented therein so as to form an approximate first right angle between a non-twisted end of the first wire and one of free ends of the second wire, and to form a second angle of approximately 135° between the free ends of the second wire;

pneumatic cylinders for forming a first loop at each free end of the first and second wires, in said first plane, and for forming a second loop in a plane substantially perpendicular to the first plane, by folding, said cylinders being able to actuate two parallel spindles rotating with respect to each other and motors with a horizontal or vertical axis depending on an orientation of the loops to be formed;

a template comprising a cap serving as a support substantially in said first plane, and three peripheral shoes for folding wire legs by pressing for folding the three wires at a certain distance from said an overlap region for twisting, in a plane substantially perpendicular to said first plane;

means for connecting a rim formed by a third wire by simultaneous passage of the third wire through the three second loops of a cage formed from the first and second wires for cooperating with the rim by translation in a direction substantially perpendicular to said first plane, and means for closing the three second loops by pressing their second free ends in a direction parallel to said first plane.

9. Machine according to claim 8, wherein the pneumatic cylinders actuate two parallel spindles rotating with respect to each other.

10. Machine according to claim 8, further comprising:

means intended to form the rim comprising several stations disposed in a carousel.

* * * * *